United States Patent [19]

Collier

[11] 4,301,702

[45] Nov. 24, 1981

[54] HOT WIRE CAVITY CUTTING APPARATUS

[76] Inventor: David L. Collier, 255 NW. 95th Ave., Portland, Oreg. 97229

[21] Appl. No.: 143,320

[22] Filed: Apr. 24, 1980

[51] Int. Cl.[3] ..... B26F 3/12

[52] U.S. Cl. ..... 83/862; 83/157; 83/167; 83/171; 83/875; 83/923

[58] Field of Search ..... 83/862, 875, 16, 171, 83/923, 157, 167

[56] References Cited

U.S. PATENT DOCUMENTS

| | | | |
|---|---|---|---|
| 3,080,612 | 3/1963 | Buchmann | 83/171 X |
| 3,610,078 | 10/1971 | Rowlands | 83/171 X |
| 3,731,567 | 5/1973 | Ross | 83/171 X |
| 3,800,643 | 4/1974 | Scott et al. | 83/171 X |

*Primary Examiner*—Frank T. Yost
*Attorney, Agent, or Firm*—Oliver D. Olson

[57] ABSTRACT

A frame supports a hollow housing which mounts thereon a hot wire die support plate from the outer side of which projects a hot wire die. The housing is pivoted to the frame for movement between an operative position in which the die projects upward for cutting a cavity in a block of material that is moved over the support plate between limit-defining stop pins, and a discharge position in which the die projects downward for the gravity release of scrap material resulting from the cutting operation. The scrap material falls onto a hot wire scrap cutting grid extending across a scrap discharge opening below the housing, whereby the scrap material is reduced to small particles as it gravitates through the hot wire grid.

11 Claims, 8 Drawing Figures

HOT WIRE CAVITY CUTTING APPARATUS

BACKGROUND OF THE INVENTION

This invention relates to the formation of cavities in blocks of packaging material, for the packaging of delicate products, and more particularly to cavity cutters of the hot wire type.

Hot wire cavity cutters have been proposed heretofore for producing in blocks of polystyrene foam or other similar material cavities which are shaped to confine a delicate product and thus provide a package by which to prevent damage to the product during shipment or other transport.

Such a hot wire cavity cutter is disclosed in U.S. Pat. No. 3,731,567. It involves the support of a packaging block for horizontal movement by a pusher member relative to a fixed, underlying hot wire die for a distance sufficient to cut the desired cavity shape into the block. The pusher thereafter engages the hot wire die, whereby simultaneously to move the block further horizontally and the hot wire die vertically downward to withdraw the hot wire die from the cut block, whereupon the scrap material cut from the block falls by gravity from the block.

SUMMARY OF THE INVENTION

In its basic concept, the hot wire cavity cutting apparatus of this invention provides for the positioning of a hot wire die in an upwardly facing operative position in which an overlying block of material is moved relative to the die to cut a cavity in the block, after which the block is removed upwardly from the die, and thereafter rotating the die to a downwardly facing discharge position in which scrap material remaining on the die after the cutting operation falls by gravity from the die.

It is the principal object of this invention to provide hot wire cavity cutting apparatus of the class described which insures positive discharge of scrap material from the die after the die cutting operation.

Another object of this invention is the provision of hot wire cavity cutting apparatus of the class described which accommodates manual manipulation of blocks to be cut, by unskilled personnel.

Still another object of this invention is to provide hot wire cavity cutting apparatus of the class described which includes means for reducing scrap material to small particles suitable for use as bulk packing material.

A further object of this invention is the provision of hot wire cavity cutting apparatus of the class described which includes a die support that accommodates the exchange of hot wire dies with speed and facility.

A still further object of this invention is the provision of hot wire cavity cutting apparatus of the class described which includes a novel mount and electrical connector for the hot wire die elements.

A further object of this invention is the provision of hot wire cavity cutting apparatus of the class described which is of simplified construction for economical manufacture and which affords long operating life with a minimum of maintenance and repair.

The foregoing and other objects and advantages of this invention will appear from the following detailed description, taken in connection with the accompanying drawings of a preferred embodiment.

DESCRIPTION OF THE PREFERRED EMBODIMENT

The components of the apparatus of this invention are mounted on a frame which includes horizontal and vertical frame members 10.

Figure 7:
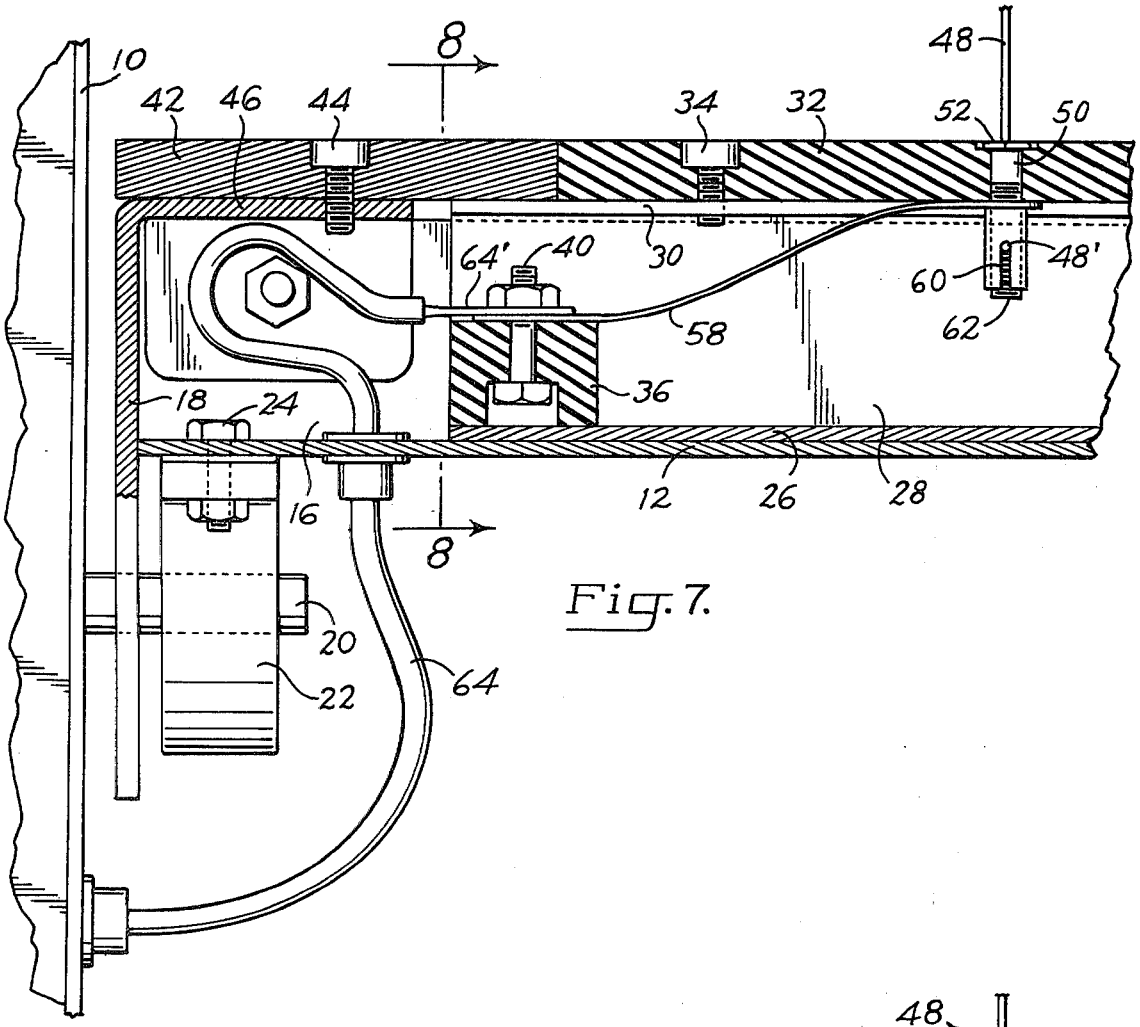
FIG. 7 is a fragmentary vertical section through the left hand portion of the hot wire die support plate and housing assembly illustrated in FIG. 1.

A hot wire die support includes a hollow housing formed of a bottom wall 12, a front wall 14, rear wall 16 and laterally spaced end walls 18. Stub shafts 20 project laterally inward from opposite sides of the frame, through openings in the end walls of the housing and are journaled in bearings 22 secured to the bottom wall of the housing, as by bolts 24 (FIG. 7).

Mounted removably within the housing is an open ended tray formed of a bottom wall 26, front and rear side walls 28 and inwardly projecting flanges 30 on the upper ends of the side walls. The tray is adapted to support a hot wire die support plate 32 by removable attachment to the flanges, as by screws 34.

Figure 8:
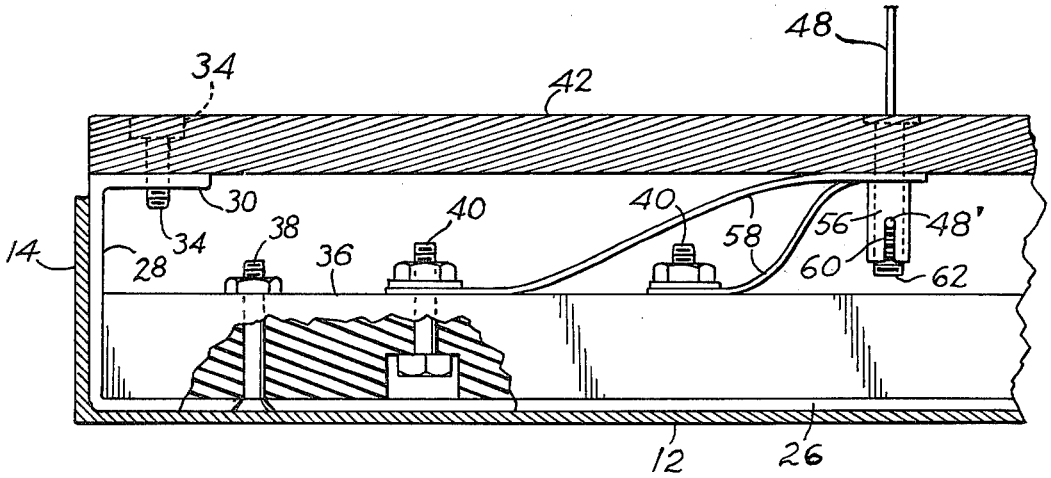
FIG. 8 is a fragmentary sectional view taken on the line 8—8 in FIG. 7.

Mounted within the tray adjacent each of the opposite ends thereof is an electrically non-conductive terminal block 36. It is secured to the bottom of the tray, as by bolts 38 (FIG. 8). Each terminal block mounts a pair of spaced and therefore electrically isolated terminal bolts 40 which function, as described hereinafter, to connect the source of electric potential to electrical resistance wire elements making up a hot wire die.

The die support plate 32 terminates inwardly of the opposite ends of the tray (FIG. 7), exposing end portions of the inturned flanges 30. With the tray installed in the housing between the front and rear walls of the latter and spaced inwardly of the opposite ends of the housing, a retainer plate 42 is secured removably to each end of the housing, as by means of screws 44 extending through openings in the plate and threaded into an inturned end flange portion 46 of the housing. Each retainer plate overlies the exposed end portion of the flanges 30 of the tray and abuts the adjacent end of the die support plate 32. The tray and plate assembly thus is held removably in place on the housing.

The hot wire die support plate is made of electrically non-conductive and heat resistant material. Although there are many materials commercially available for this purpose, the asbestos and concrete composite sold by Johns-Manville under the trademark Transite, has been found to be quite satisfactory.

The die plate supports a plurality of electrical resistance wires 48 in a predetermined pattern to form a die by which to cut one or more cavities in a block of packaging material, such as polystyrene foam. The wires are secured to the plate and project outwardly from the outer surface of the plate in shapes predetermined to cut desired segments of material from the block. The opposite ends of each wire element extend through the plate for connection across a source of electric potential, as will be understood.

Figure 5:
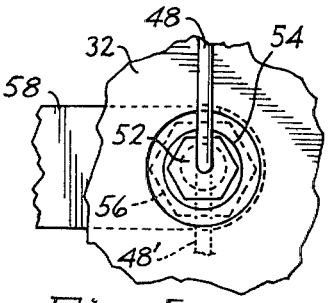
FIG. 5 is a fragmentary plan view as viewed from the top in FIG. 4.
Figure 4:
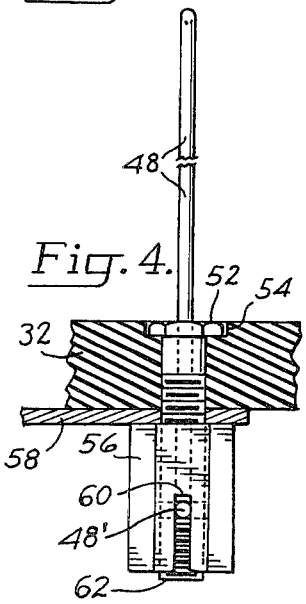
FIG. 4 is a fragmentary, foreshortened vertical section through a hot wire die support plate showing a die wire support and electrical connector embodying features of this invention.
Figure 6:
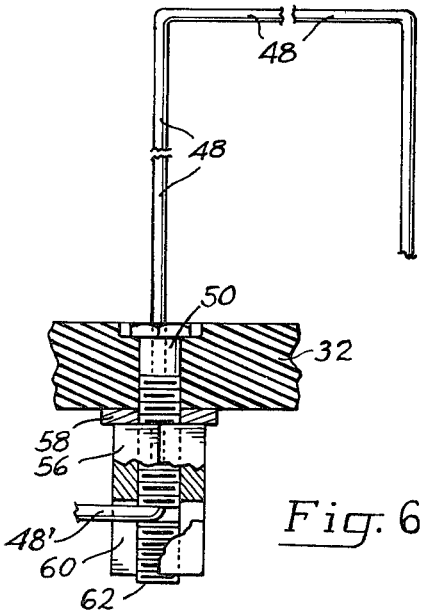
FIG. 6 is a fragmentary, foreshortened vertical section as viewed from the right in FIG. 4.

In the preferred embodiment illustrated, novel means is provided for mounting each wire element on the plate 32 and making electrical connection to it. As best illustrated in FIGS. 4, 5 and 6, an elongated, longitudinally hollow pin 50 extends through a transverse hole in the plate. An enlarged head 52 on one end of the pin enters a counterbore 54 in the outer surface of the plate to limit the extension of the pin through the plate. The surface of the enlarged head preferably is made flush with the outer surface of the plate.

The pin 50 projects a distance beyond the inner surface of the plate and is threaded externally for the removable reception of a nut 56. An electrical conductor 58, provided with an opening for the reception of the pin, first is installed on the pin and then the nut is tightened down so as to clamp the electrical conductor between the nut and inner surface of the plate.

The nut is elongated, and is provided with a transverse slot 60 which extends inwardly from its outer end, i.e. the end opposite the electrical conductor 58, and terminates intermediate the longitudinal ends of the nut.

Thus, one end portion of an electrical resistance wire 48 is extended through the hollow pin 50, with a terminal end portion 48' of the wire projecting from the inner end of the pin. The wire exposed on the outer surface of the plate then is bent to desired shape and adjusted so as to project the desired distance outwardly from the outer surface of the plate. The terminal end portion 48' of the wire projecting from the inner end of the pin then is bent outwardly through the slot 60 in the nut to form a substantially right angle bend at the inner end of the pin. A set screw 62 then is threaded into the terminal end portion of the nut and brought into clamping engagement with the bent portion of the wire. The wire thus is secured positively but removably to the plate.

By bending the inner terminal portion 48' of the wire and clamping it with the set screw 62 against the inner end of the pin, the wire projecting outwardly from the outer surface of the plate is prevented from moving vertically relative to the plate, whereby to insure the maintenance of the established dimensions of the shape of wire projecting from the plate. Moreover, by retaining the bent portion of the wire within the transverse slot 60 in the nut, the portion of wire projecting outwardly from the outer end of the plate is prevented from twisting under the force of movement of a block being cut. This insures the formation of accurately dimensioned cavities within the block of packaging material.

The connector described hereinbefore is utilized to mount each end of each resistance wire element of the hot wire die to the plate 32 and to connect each wire end to a different one of the pair of terminal bolts 40 at one end of the tray. Each bolt 40 of the pair serves to removably connect the terminal end 64' of an infeed electrical conductor 64 the opposite end of which is connected to a source of electric potential.

Figure 1:
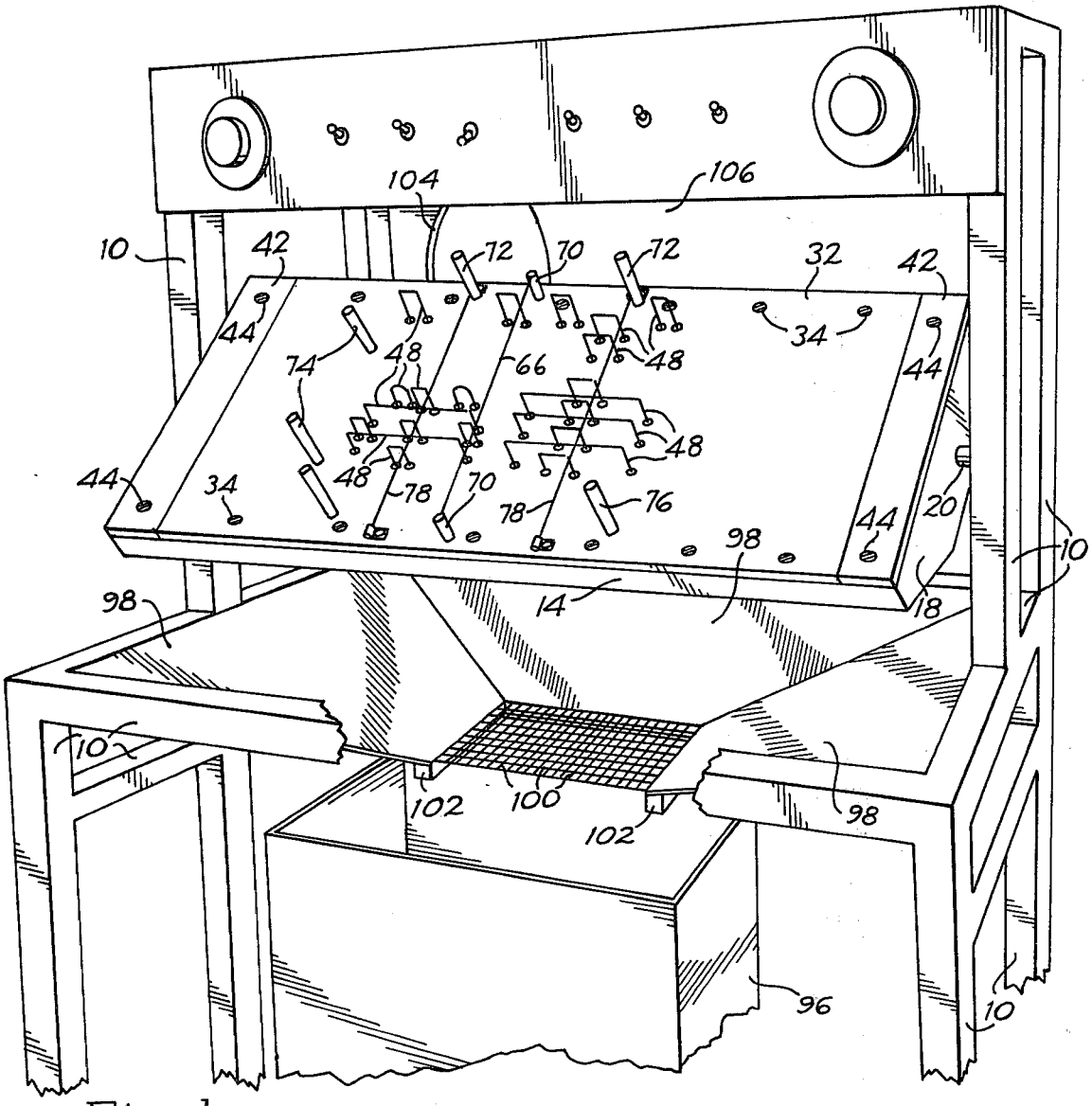
FIG. 1 is a fragmentary front perspective view of hot wire cavity cutting apparatus embodying the features of this invention.
Figure 3:
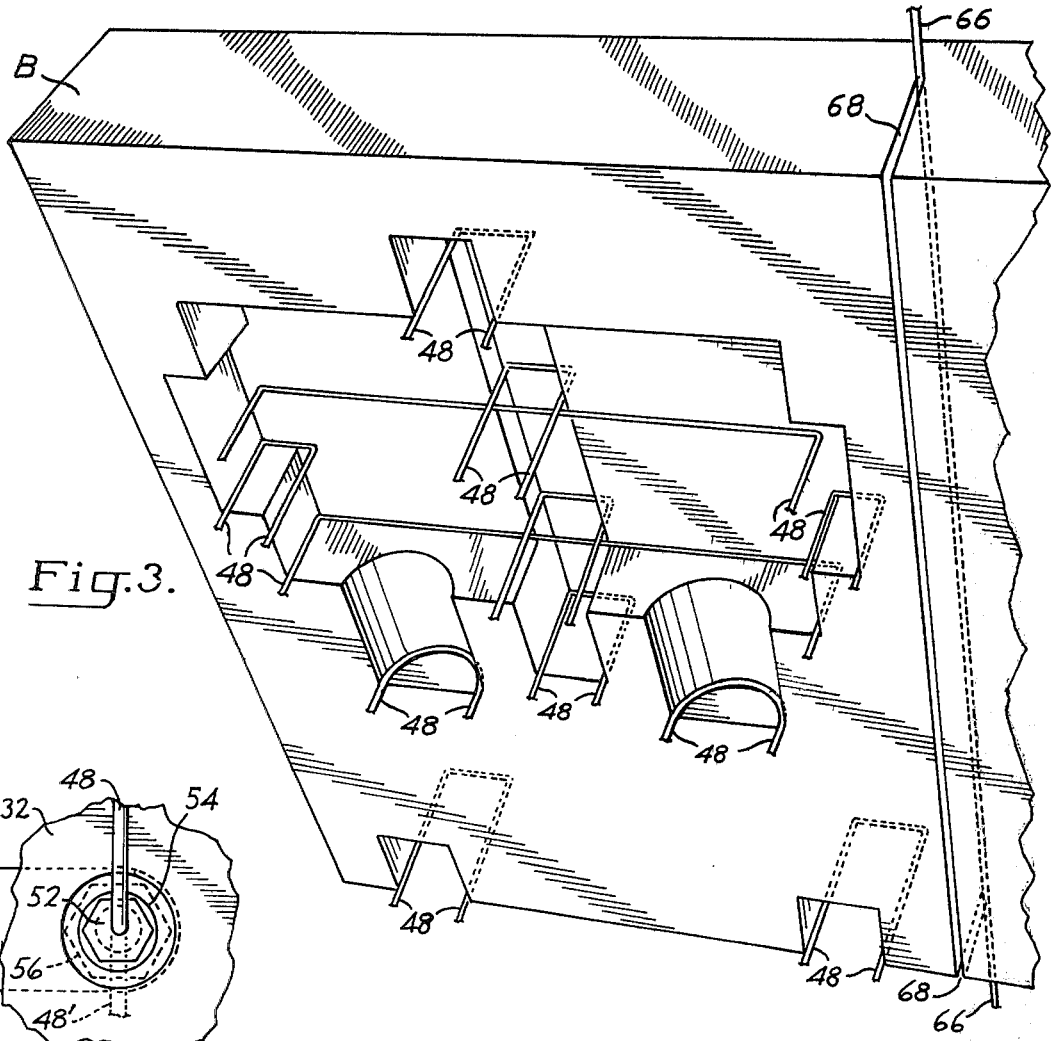
FIG. 3 is a fragmentary bottom perspective view of a portion of a block of synthetic plastic foam material showing a cavity formed therein by a hot wire die, in accordance with this invention.

FIG. 1 of the drawings shows the plate 32 supporting a pair of hot wire dies located side-by-side and operable to produce two laterally spaced cavities of different configurations in a block of packaging material. A separation hot wire 66 is located between the pair of dies and serves to provide a serverance cut 68 in the block B. As shown in FIG. 3, the separation hot wire is arranged to cut through a major portion of the thickness of the block, leaving an interconnecting web portion so that the entire block may be manipulated over the support plate to effect the curting operation for the two cavities. To this end, the separation hot wire is stretched between a pair of terminals 70 mounted on the plate and projecting upwardly therefrom to locate the wire the desired predetermined distance above the plate.

The cavity cutting operation is achieved by heating the wires of the dies to a temperature predetermined to effect melting of the material of the block contacted by the hot wires. Rheostats in the electrical supply circuit to the dies enable adjustment of the temperature of the wires to optimum condition with respect to the particular foamed material employed for the blocks.

With the hot wire dies heated to proper temperature, a block of packaging material is supported manually over the dies, in abutment with the stop pins 72 adjacent the upper side of the die in FIG. 1 and the stop pins 74 to the left side of the die. The block then is pressed downward onto the heated die wires, until the bottom surface of the block rests upon the die support plate. The block then is moved manually downward, toward the operator standing in front of the die plate, until the lower side of the block abuts the stop pins 76 projecting upward from the plate adjacent the bottom side thereof.

After the block has been moved downward into abutment with the stop pins, the block then is lifted manually upward to retract it from the hot wire die elements, thereby completing the cavity cutting operation. If desired, the block may be broken in half, in the area of the web registering with the serverance cut 68.

It is to be noted, in FIG. 1, that the housing is arranged to support the plate 32 in an position inclined away from the operator. This is the preferred arrangement, although it will be understood that the operative position of the plate may be horizontal, or any other angle desired.

In the embodiment illustrated, a pair of heat resistant spacer bars 76 are mounted on the die support plate 32, in laterally spaced-apart arrangement, and project slightly above the upper surface of the plate. These bars serve as abutments for the underside of a block to be cut, maintaining the latter elevated slightly above the plate and thus minimizing the deposit of melted plastic material from the block onto the plate. This also minimizes the frictional resistance to movement of the block during the cutting operation.

Replacement of one hot wire die assembly for another of different shape is achieved simply by removing the end retainer plates 42, by loosening the screws 44, and then removing the nuts on the terminal bolts 40 and disconnecting the terminals 64' of the infeed conductors 64. The tray with attached die support plate 32 then may be lifted from the housing and replaced with another tray and plate assembly containing one or more differently shaped hot wire dies. The terminals of the infeed conductors then are attached to the terminal bolts, and the nuts tightened down to secure the connection, after which the retainer plates 42 are reinstalled on the housing at the opposite ends of the die plate to secure the latter and its tray to the housing.

The scrap material remaining after the cavitity cutting operation remains on the die support plate 32. Accordingly, means is provided for moving the plate from its operative position illustrated in FIGS. 1 and 2 to a scrap material discharge position illustrated diagrammatically in broken lines in FIG. 2. In this position the plate and the die wires face downward, allowing the scrap material to fall by gravity from the plate.

Figure 2:
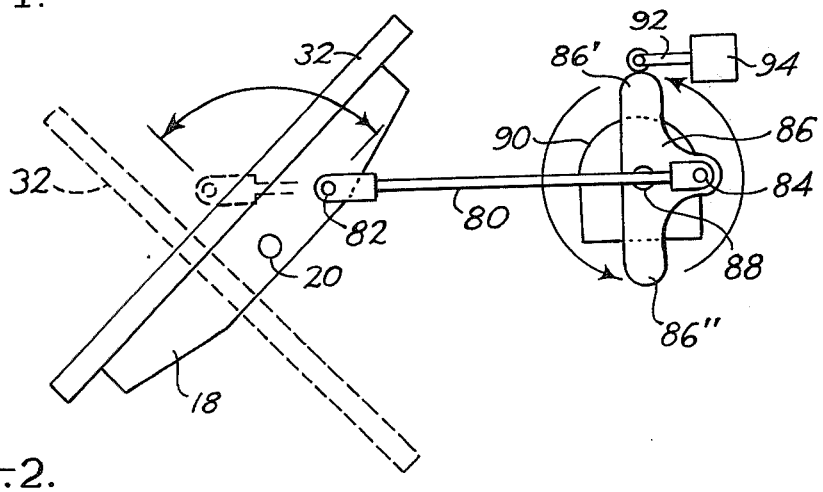
FIG. 2 is a diagrammatic view in side elevation illustrating a manner in which the die support may be pivoted between an operative position illustrated in full lines and a discharge position illustrated in broken lines.

FIG. 2 also illustrates means by which the die support plate is moved between the operative position illustrated in full lines and the discharge position illustrated in broken lines. One end of an elongated link 80 is connected pivotally, by a pivot pin 82, to an end wall 18 of the housing which supports the die plate. The opposite end of the link is connected pivotally, by a pivot pin 84, to a cam member 86 which is mounted for rotation on the output rotary shaft 88 of an electric drive motor 90. Since the pivot connection 84 of the link is spaced from the mounting 88 of the cam member on the motor shaft, rotation of the cam member results in oscillatory motion of the link and hence of the housing and die support plate 32 between the operative and discharge positions described hereinbefore.

A foot-operated electric switch (not shown) in the electric circuit of the drive motor 90 serves to initiate activation of the motor. It is a momentary contact type switch, completing the circuit when the switch button is depressed by the foot and opening the circuit when the foot is removed from the switch button. Activation of the motor, however, initiates rotation of the cam member 86 from the position illustrated in FIG. 2 wherein the actuator arm 92 of a stop switch 94 is engaged by a cam lobe 86' to open the stop switch. This switch is arranged in parallel with the foot operated switch previously mentioned. Accordingly, upon activation of the drive motor the cam member will be rotated 180° in the counterclockwise direction illustrated by the arrows, since disengagement of the actuator arm of the stop switch 94 from the cam lobe functions to close the stop switch. When the cam lobe 86'' displaced 180° from the lobe 86' engages the switch arm and opens the stop switch, the electric motor is deenergized and the housing and die support plate 32 are stopped in the scrap discharge position illustrated in broken lines in FIG. 2.

To return the plate to the operative position illustrated in full lines in FIG. 2, the foot operated switch once again is depressed momentarily and released, to initiate activation of the motor and rotation of the cam member through 180°, as will be understood.

When the housing and die plate are rotated to the scrap discharge position illustrated in broken lines in FIG. 2, the scrap material falling from the plate is directed to scrap storage, as exemplified by the large cardboard carton 96 illustrated in FIG. 1. For this purpose, a funnel-shaped discharge collector is mounted on the frame under the housing and plate. The discharge collector is formed of a plurality of sheet metal plates 98 secured to the frame 10 and converging downwardly toward each other to the central discharge opening through which the scap material is directed into the container.

In the preferred embodiment illustrated, means is provided for reducing this scrap material to small particles capable of use as bulk packing material, in the traditional manner of pop-corn and similarly sized particles of foamed synthetic thermoplastic resins. For this purpose a hot wire scrap cutter is mounted across the discharge opening. In the embodiment illustrated, the scrap cutter is provided in the form of a grid 100 of spaced-apart electrical resistance wires supported by a peripheral frame 102 of electrically non-conductive material secured to the plates 98 forming the discharge funnel. The resistance wires are connected to a source of electric potential, in manner similar to the hot wire die elements 48. Thus, as pieces of scrap fall upon the heated grid, they gravitate by their own weight downward through the grid, thereby being reduced to small particles which are collected in the container 96.

It will be appreciated that the scrap collecting container may be replaced with a suction duct or belt type conveyor, or other suitable means, to accommodate large volume production operations.

In the embodiment illustrated, an opening 104 in the back wall 106 of the frame 10 registers with a fan or other suitable source of vacuum (not shown) to draw from the proximity of the operator the noxious fumes produced by the hot wire cutting operations.

Although the manual operation of the apparatus described hereinbefore is preferred for simplicity of construction of the apparatus and economy of small scale production, it will be apparent that the manual operations may be replaced by automated mechanical operations, if desired.

It will be apparent to those skilled in the art that various changes may be made in the size, shape, type, number and arrangement of parts described hereinbefore, without departing from the spirit of this invention and the scope of the appended claims.

Having now described my invention and the manner in which it may be used, I claim:

1. Hot wire cutting apparatus for cutting cavities in blocks of packaging material, comprising:

(a) a frame, (b) a hot wire die support, (c) a hot wire die projecting outwardly from the die support, and (d) means mounting the die support on the frame for movement of the die support between an operative position in which the hot wire die projects upward for supporting on the die support a block to be cut, and a discharge position in which the hot wire die projects downward for the gravity release of scrap material remaining on the die support after cutting a cavity in a block.

2. The apparatus of claim 1 including stop means on the die support arranged to define the limits of movement thereover of a block to be cut.

3. The apparatus of claim 1 wherein the die support mounting means comprises pivot means interengaging the frame and die support for allowing rotation of the die support relative to the frame, and reciprocative drive means interengaging the frame and die support for pivoting the latter between said operative and discharge positions.

4. The apparatus of claim 1 including a scrap discharge member on the frame having a discharge opening located below the die support for the gravity discharge of scrap material therethrough.

5. The apparatus of claim 4 including a hot wire scrap cutter extending across the discharge opening for reducing scrap material to smaller particles.

6. The apparatus of claim 5 wherein the scrap cutter comprises a grid of hot wires arranged to reduce scrap material to smaller particles as the scrap material gravitates through the grid.

7. The apparatus of claim 1 wherein (a) the die support mounting means comprises pivot means interengaging the frame and die support for allowing rotation of the die support relative to the frame, and reciprocative drive means interengaging the frame and die support for pivoting the latter between said operative and discharge positions, (b) a scrap discharge member is mounted on the frame having a discharge opening located below the die support for the gravity discharge of scrap material therethrough, (c) a hot wire scrap cutter extends across the discharge opening for reducing scrap material to smaller particles, the scrap cutter comprising a grid of hot wires arranged to reduce scrap material to smaller particles as the scrap material gravitates through the grid, and (d) stop means on the die support are arranged to define the limits of movement thereover of a block to be cut.

8. The apparatus of claim 1 wherein (a) the die support includes a plate having an outer surface from which the hot wire die projects, (b) a hollow housing is mounted on the frame by the mounting means and is arranged to removably secure the die support plate with the inner surface of the plate facing into the hollow housing, (c) a pair of electric terminal means is located in the housing and has secured thereto one end of a first pair of electrical conductors the opposite ends of which are connected to the hot wire die, and (d) a second pair of electrical conductors is arranged for connection at one end to a source of electric potential and is connected at the opposite end removably to the pair of electric terminal means, whereby to facilitate changing the die support plate and hot wire die.

9. The apparatus of claim 1 wherein:

(a) the die support includes a plate having an outer surface from which the hot wire die projects, and the tray mounting the plate, (b) a hollow housing is mounted on the frame by the mounting means and is arranged to removably secure the tray with the inner surface of the die support plate facing into the hollow housing, (c) a pair of electric terminal means is mounted on the tray and has secured thereto one end of a first pair of electrical conductors the opposite ends of which are connected to the hot wire die, and (d) a second pair of electrical conductors is arranged for connection at one end to a source of electric potential and is connected at the opposite end removably to the pair of electric terminal means, whereby to facilitate changing the die support plate and hot wire die.

10. The apparatus of claim 1 wherein:

(a) the die support includes a plate having an outer surface from which the hot wire projects, (b) a longitudinally hollow pin is supported by the plate and projects a distance beyond the inner surface thereof, said projecting portion of the pin having an external thread, (c) a nut is threaded onto the inner projecting portion of the pin for securing an electrical conductor between the nut and the inner surface of the plate, (d) the nut has an elongated slot extending axially thereof from its inner end and terminating intermediate the ends of the nut, (e) a die wire extends through the hollow pin and has an inner end portion bent at substantially right angles to the pin and abutting the inner end thereof and projecting radially outward through the slot in the nut, and (f) a set screw is threaded into the slotted portion of the nut and abuts the bent portion of the die wire.

11. The apparatus of claim 1 wherein:

(a) the die support mounting means comprises pivot means interengaging the frame and die support for allowing rotation of the die support relative to the frame, and reciprocative drive means interengaging the frame and die support for pivoting the latter between said operative and discharge positions, (b) a scrap discharge member on the frame has a discharge opening located below the die support for the gravity discharge of scrap material therethrough, (c) a hot wire scrap cutter extends across the discharge opening for reducing the scrap material to smaller particles, the scrap cutter comprising a grid of hot wires arranged to reduce scrap material to smaller particles as the scrap material gravitates through the grid, (d) the die support includes a plate having an outer surface from which the hot wire die projects, (e) a hollow housing is mounted on the frame by the mounting means and is arranged to removably secure the die support plate with the surface of the plate facing into the hollow housing, (f) a pair of electric terminal means in the housing has secured thereto one end of a first pair of electrical conductors the opposite ends of which are connected to the hot wire die, (g) a second pair of electrical conductors is arranged for connection at one end to a source of electric potential and is connected at the opposite end removably to the pair of electric terminal means, whereby to facilitate changing the die support plate and hot wire die, (h) stop means on the die support plate are arranged to define the limits of movement thereover of a block to be cut, (i) a longitudinally hollow pin is supported by the plate and projects a distance beyond the inner surface thereof, said projecting portion of the pin having an external thread, (j) a nut is threaded onto the inner projecting portion of the pin for securing an electrical conductor between the nut and the inner surface of the plate, (k) the nut having an elongated slot extending axially thereof from its inner end and terminating intermediate the ends of the nut, (l) a die wire extends through the hollow pin and has an inner end portion bent at substantially right angles to the pin and abuts the inner end thereof and projects radially outward through the slot in the nut, and (m) a set screw is threaded into the slotted portion of the nut and abuts the bent portion of the die wire.

* * * * *